US008714304B2

(12) United States Patent
Kitamura

(10) Patent No.: US 8,714,304 B2
(45) Date of Patent: May 6, 2014

(54) SOUNDPROOFING PLATE AND SOUNDPROOFING DEVICE PERMITTING AIR FLOW

(71) Applicant: Yoshiharu Kitamura, Tokyo (JP)

(72) Inventor: Yoshiharu Kitamura, Tokyo (JP)

( * ) Notice: Subject to any disclaimer, the term of this patent is extended or adjusted under 35 U.S.C. 154(b) by 0 days.

(21) Appl. No.: 13/980,322

(22) PCT Filed: Sep. 21, 2012

(86) PCT No.: PCT/JP2012/074228

§ 371 (c)(1),
(2), (4) Date: Jul. 18, 2013

(65) Prior Publication Data

US 2014/0083796 A1 Mar. 27, 2014

(51) Int. Cl.

| | |
|---|---|
| ***E04B 1/84*** | (2006.01) |
| ***E04B 1/82*** | (2006.01) |
| *E04B 1/74* | (2006.01) |
| *G10K 11/16* | (2006.01) |

(52) U.S. Cl.
USPC ..... 181/286; 181/293; 181/210; 52/144

(58) Field of Classification Search
USPC ..... 181/286, 293, 295, 288, 210, 284; 52/144, 145
See application file for complete search history.

(56) References Cited

U.S. PATENT DOCUMENTS

| | | | | |
|---|---|---|---|---|
| 1,783,276 | A * | 12/1930 | Bliss | 454/206 |
| 2,280,631 | A * | 4/1942 | Coffey | 181/293 |
| 3,159,090 | A * | 12/1964 | Schutt | 454/270 |
| 3,174,580 | A * | 3/1965 | Schulz et al. | 181/290 |
| 3,597,891 | A | 8/1971 | Martin et al. | |
| 3,814,208 | A * | 6/1974 | Morresi et al. | 181/293 |
| 3,887,031 | A * | 6/1975 | Wirt | 181/286 |
| 5,004,070 | A * | 4/1991 | Wang | 181/286 |
| 5,185,504 | A * | 2/1993 | Jen | 181/286 |

(Continued)

FOREIGN PATENT DOCUMENTS

| | | |
|---|---|---|
| EP | 2 657 932 A1 | 10/2013 |
| JP | A 63-153592 | 6/1988 |

(Continued)

OTHER PUBLICATIONS

Nov. 13, 2012 Translation of Written Opinion issued in International Application No. PCT/JP2012/074228.

(Continued)

*Primary Examiner* — Edgardo San Martin
(74) *Attorney, Agent, or Firm* — Oliff PLC

(57) ABSTRACT

A soundproofing plate comprising a substrate having a substrate having at least one through hole formed therein; and a soundproofing device mounted on the through hole of the substrate. The soundproofing device has a multiplex structure having at least a first structure and a second structure nested therein. The first structure comprises a through hole ("first air passage hole") disposed in the center and communicating with the through hole of the substrate, and a first sound collecting portion disposed at both ends or one end and having a larger size than the aperture area of the first air passage hole, and being arranged so as to reflect incident noise. The second structure comprises a through hole ("second air passage hole") disposed in the center and communicating with the through hole of the substrate, and a second sound collecting portion disposed at both ends or one end and having a larger size than the aperture area of the second air passage hole, and being arranged so as to reflect incident noise.

11 Claims, 4 Drawing Sheets

(56) References Cited

U.S. PATENT DOCUMENTS

| | | | | | |
|---|---|---|---|---|---|
| 5,422,446 | A * | 6/1995 | Fries | 181/293 |
| 5,445,861 | A * | 8/1995 | Newton et al. | 428/116 |
| 5,457,291 | A * | 10/1995 | Richardson | 181/293 |
| 5,491,310 | A * | 2/1996 | Jen | 181/286 |
| 5,760,349 | A * | 6/1998 | Borchers et al. | 181/286 |
| 6,035,965 | A * | 3/2000 | Fujiwara et al. | 181/293 |
| 6,125,965 | A * | 10/2000 | Wang | 181/286 |
| 6,187,401 | B1 * | 2/2001 | Heisel et al. | 428/36.9 |
| 6,352,134 | B1 * | 3/2002 | Wang | 181/292 |
| 6,617,002 | B2 * | 9/2003 | Wood | 428/131 |
| 6,977,109 | B1 * | 12/2005 | Wood | 428/131 |
| 7,413,053 | B2 * | 8/2008 | Wasif et al. | 181/293 |
| 7,451,855 | B2 * | 11/2008 | Wang | 181/286 |
| 8,413,443 | B2 * | 4/2013 | Johnson | 60/725 |
| 8,579,080 | B2 * | 11/2013 | Angelico | 181/293 |
| 2002/0175023 | A1 * | 11/2002 | Wilson | 181/293 |
| 2009/0038883 | A1 * | 2/2009 | Kim | 181/291 |
| 2013/0265704 | A1 * | 10/2013 | Kowalczyszyn et al. | 361/679.01 |

FOREIGN PATENT DOCUMENTS

| | | | | |
|---|---|---|---|---|
| JP | B2-8-23753 | | 3/1996 | |
| JP | A 10-39875 | | 2/1998 | |
| JP | A 2002-367298 | | 12/2002 | |
| JP | A 2003-21373 | | 1/2003 | |
| JP | 2005031240 | A * | 2/2005 | G10K 11/172 |
| JP | A 2005-31240 | | 2/2005 | |
| JP | A 2006-250022 | | 9/2006 | |
| JP | A 2008-544119 | | 12/2008 | |
| JP | A-2010-191029 | | 9/2010 | |
| JP | A-2010-191030 | | 9/2010 | |
| WO | WO 2010/057945 | A1 | 5/2010 | |
| WO | WO 2012/086680 | A1 | 6/2012 | |

OTHER PUBLICATIONS

Jan. 16, 2014 Supplementary European Search Report issued in European Application No. 12 86 4681.

* cited by examiner

Sound Pressure Difference by Frequency (Automobile Traffic Noise v. When Open)

SOUNDPROOFING PLATE AND SOUNDPROOFING DEVICE PERMITTING AIR FLOW

TECHNICAL FIELD

The present invention relates to a soundproofing plate for effectively reducing transmitted acoustic energy while permitting the flow of air, and a soundproofing device mounted on such a soundproofing plate.

BACKGROUND ART

A general method of shielding against noise from indoors or outdoors is by shutting it out with walls, doors or windows. Additionally, when noise is generated within a specific area, there are methods of sealing off the relevant area. Methods for doing so include using tightly sealable sashes for doors and windows, giving them a double structure, or using sound-absorbing materials. In any case, this usually necessitates blocking the flow of air between the source of the noise and the area to be soundproofed.

On the other hand, soundproofing methods allowing air flow include those such as the "soundproofed low energy consumption healthy living room system using natural circulation of outdoor air" described in JP 2003-21373 A, wherein box-shaped tubes with air passage holes are provided, these air passage holes are filled with a sound-absorbing material, and the boxes are provided with complicated air flow routes to reduce noise, as well as the "sound insulating material structure and soundproofing structure of an air conditioner" described in JP H10-39875 A, wherein porous through holes are added and a foamed material is used.

Alternatively, there are methods such as mufflers for reducing engine exhaust noise and noise cancellers or silencers for reducing the firing noise of guns. The "internal combustion engine exhaust noise reducing device and exhaust noise tuning method using said device" of JP 2006-250022 A has a gas flow path of at least a certain length and the flow of gas is made complicated to raise the sound insulating effect.

Furthermore, methods of canceling noise by manipulating the acoustic signal of noise, called noise-canceling speakers or noise cancellers, are known. JP 2002-367298 A provides examples of noise canceller devices and noise canceling methods.

In order to improve on the conventional soundproofing technologies mentioned above, the present applicant proposed an improved soundproofing plate for effective reducing transmitted acoustic energy while permitting the flow of air in WO 2012/086680, the entire disclosure of which is hereby incorporated by reference. The proposed soundproofing plate comprises a substrate having a through hole formed therein, and a soundproofing device mounted on the through hole of the substrate. This soundproofing device comprises a sound collecting portion having in the center a through hole ("air passage hole") communicating with the through hole in the substrate, both ends or one end being of a larger size than the air passage hole of the device, and being arranged so as to reflect incident noise. According to the proposed soundproofing plate, an effective soundproofing effect can be achieved while enabling passage of outside air without consuming artificial energy such as for air conditioning or the like. However, even this proposed soundproofing plate left room for improvement.

RELATED ART DOCUMENTS

Patent Documents

Patent Document 1: JP 2003-21373 A
Patent Document 2: JP H10-39875 A
Patent Document 3: JP 2006-250022 A
Patent Document 4: JP 2002-367298 A
Patent Document 5: WO 2012/086680

SUMMARY OF THE INVENTION

Problems to be Solved by the Invention

The present invention has the purpose of offering an improved soundproofing plate and soundproofing device, and in particular has the specific purpose of improving on the type of soundproofing plate and soundproofing device disclosed in WO 2012/086680.

Means for Solving the Problems

One aspect of the present invention offers a soundproofing plate comprising:

a substrate having at least one through hole formed therein; and a soundproofing device mounted on the through hole of the substrate;

the soundproofing device having a multiplex structure having at least a first structure and a second structure nested therein;

the first structure comprising a through hole ("first air passage hole") disposed in the center and communicating with the through hole of the substrate, and a first sound collecting portion disposed at both ends or one end and having a larger size than the aperture area of the first air passage hole, and being arranged so as to reflect incident noise; and the second structure nested in the first structure, comprising a through hole ("second air passage hole") disposed in the center and communicating with the through hole of the substrate, and a second sound collecting portion disposed at both ends or one end and having a larger size than the aperture area of the second air passage hole, and being arranged so as to reflect incident noise.

With this structure, the soundproofing effect is improved compared to the type of soundproofing plate proposed in WO 2012/086680. Furthermore, with the soundproofing plate of the type proposed in said publication, the soundproofing effect tended to decrease in high frequency bands (typically bands above 4000 Hz), but the present structure is capable of suppressing this tendency to decrease.

Additionally, another aspect of the present invention offers a soundproofing device mounted on a through hole of a substrate;

the soundproofing device having a multiplex structure having at least a first structure and a second structure nested therein;

the first structure comprising a through hole ("first air passage hole") disposed in the center and communicating with the through hole of the substrate, and a first sound collecting portion disposed at both ends or one end and having a larger size than the aperture area of the first air passage hole, and being arranged so as to reflect incident noise; and the second structure nested in the first structure, comprising a through hole ("second air passage hole") disposed in the center and communicating with the through hole of the substrate, and a second sound collecting portion disposed at both ends or one end and having a larger size than the aperture area of the second air passage hole, and being arranged so as to reflect incident noise.

Based on the characteristics of the present invention, the soundproofing device is a multiplex structure comprising at least one structure ("outer structure") and a second structure ("inner structure") nested therein. Here, "nested" means that the inner structure is housed inside the outer structure. Typically, the inner structure and the outer structure will be of similar shape.

In one embodiment, the first and second sound collecting portions are provided on both ends of the multiplex structure. In another embodiment, the first structure has a first hollow axial member, inside which is defined the first air passage hole, and the second structure has a second hollow axial member, inside which is defined the second air passage hole. In this case, the first and second sound collecting portions may be provided on both ends of the first and second hollow axial members.

In one embodiment, the first hollow axial member and the second hollow axial member may be integrated into a single hollow axial member. In that case, the first air passage hole and the second air passage hole are not separate holes (two concentric holes), but rather the same.

Manufacture is made easier if the first air passage hole is a single air passage hole, but if desired, a plurality of air passage holes may be formed in the central portion of the first structure. Similarly, manufacture is made easier if the second air passage hole is a single air passage hole, but if desired, a plurality of air passage holes may be formed in the central portion of the second structure.

In one embodiment, the multiplex structure constituting the soundproofing device may comprise a third structure nested in the second structure. If desired, the multiplex structure of the soundproofing device may have a quadruple or greater multiplex structure.

For the purposes of the present invention, a substrate is a board-shaped construction for covering an opening, comprising a glass pane, an iron panel, a concrete panel, a precast concrete panel or a composite panel, generally with a flat planar structure, but it need not be limited to a board shape, and the material also need not be limited to the above, as long as it is capable of achieving the purpose of covering an opening. A through hole is an aperture that passes from one side of the substrate to the other, most typical of these being linear through holes having a constant diameter, but the through hole may have a bent shape, or the diameter may change in the middle. While multiple through holes are usually formed in the substrate, the possibility of having just one through hole is not excluded.

The surface of the first and second sound collecting portions that can be seen from outside perpendicular to the substrate surface (referred to here as the "sound collecting surface") may be bowl-shaped or a conical depression. Additionally, while the typical shape of a sound collecting surface is a rotated shape centered about an axis perpendicular to the substrate, the shape may have angles (seams) around the axis, such as a square pyramid or a hexagonal pyramid. Additionally, the shape of the first and second sound collecting portions may be a shape wherein the diameter increases as the distance from the central portion of the structure increases.

The soundproofing device comprising first and second sound collecting portions (multiplex sound collecting portions) may be provided on just one side of the substrate, or provided on both sides (both surfaces) of the substrate. When the noise source is located on only one side of the soundproofing plate, when the purpose is only to reduce the noise level propagating from one side to the other, or when there is a need for one surface of the substrate to be flat, then the soundproofing device must be provided on only one side of the substrate.

The multiplex sound collecting portion may be provided on both ends of the soundproofing device, and when forming a soundproofing plate by arranging these soundproofing devices on a substrate, the soundproofing plate reduces the sound pressure of noise passing in both directions.

The shape of the multiplex sound collecting portion should preferably be spherical, ellipsoidal, parabolic or conical, but the shape is not limited thereto. Additionally, while the cross section containing an axis perpendicular to the substrate surface may be a curve whose diameter increases as the distance from the substrate increases, the curve may be such that the diameter conversely decreases as the distance from the substrate further increases, in other words, the sound collecting surface may have a shape forming a vase-shaped space with a small mouth.

The shape of the sound collecting portion may be that of a three-dimensional surface traced by moving a two-dimensional arc, ellipse, parabola, hyperbola or straight line in a direction perpendicular to the two-dimensional plane, wherein the edge portion is rectangular. Furthermore, the movement may be movement along a curve rather than straight-line motion along the direction perpendicular to the two-dimensional surface. The sound collecting surface may, for example, have the shape of an upright square pyramid composed of four planes, a hexagonal pyramid, or an octagonal pyramid, and the inclined surface of the sound collecting surface appearing at a cross section cut at a plane containing an axis perpendicular to the plane of the substrate may be an outwardly bulging curve or an inwardly bulging curve instead of a straight line. Furthermore, the shape of a cross section of the sound collecting surface when cut on a plane parallel to the surface of the substrate may be a circle, or may be a polygon, an outwardly bulging polygon, or an inwardly bulging polygon.

MODES FOR CARRYING OUT THE INVENTION

Herebelow, modes for carrying out the present invention will be described in detail with reference to the drawings as needed. However, the examples of the present invention described below are intended as illustrative examples for aiding in comprehension of the present invention, so the present invention should not be construed as being limited to the examples, experimental examples or embodiments described below.

Embodiments of the present invention will now be described.

Figure 1:
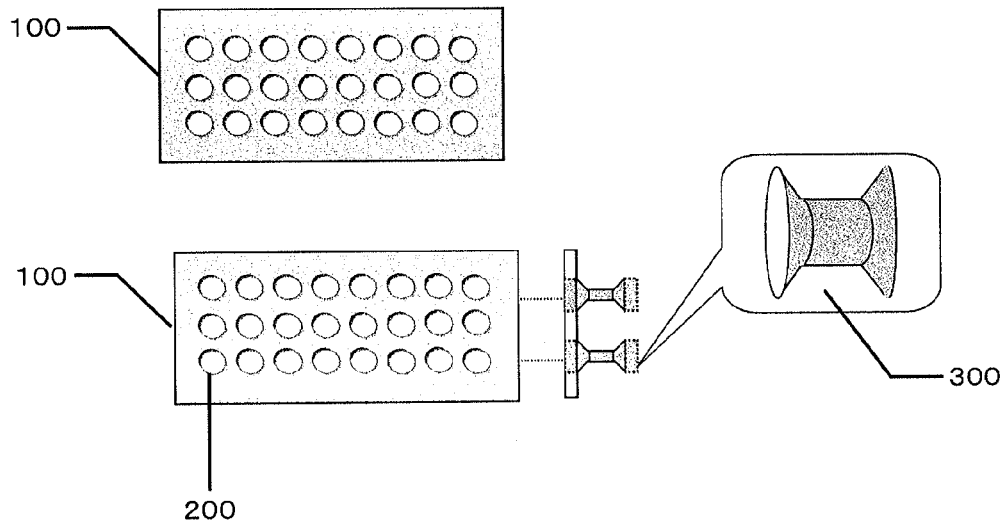
FIG. 1 A schematic view of a substrate and soundproofing device used in a soundproofing plate.

FIG. 1 is a schematic view showing a substrate 100 which is a constituting element of a soundproofing plate. The substrate 100 has 24 through holes 200 arranged in three rows. To describe the respective dimensions for reference, the dimensions of the substrate 100 in the lateral direction in the drawing is 300 to 450 mm, the diameter of the through holes 200 is 15 to 40 mm, and the pitch between the holes is about 30 to 180 mm. The through holes 200, as per their names, are apertures penetrating through the substrate 100.

The soundproofing plate is formed by mounting soundproofing devices 300 over the through holes 200 in the substrate 100. Herebelow, a plurality of possible forms of the soundproofing device 300 shall be explained.

Figure 2:
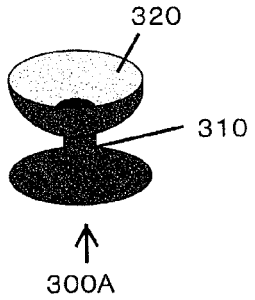
FIG. 2 A schematic view of a soundproofing device according to a comparative reference example.

FIG. 2 shows a soundproofing device 300A according to a comparative reference example. The soundproofing device 300A has in the center a through hole ("air passage hole") communicating with the through hole 200 of the substrate 100, and at both ends thereof, has sound collecting portions 320 of a larger size than the aperture area of the air passage hole, arranged to reflect the incident noise. In FIG. 2, the central portion 310 is composed of a hollow axial member having an air passage hole formed on the inside, but the length of the central portion may be substantially zero. Additionally, while FIG. 2 shows a sound collecting portion 320 on both ends of the central portion 310 (hollow axial member), the sound collecting portion may be formed at only one end of the central portion 310.

Figure 3:
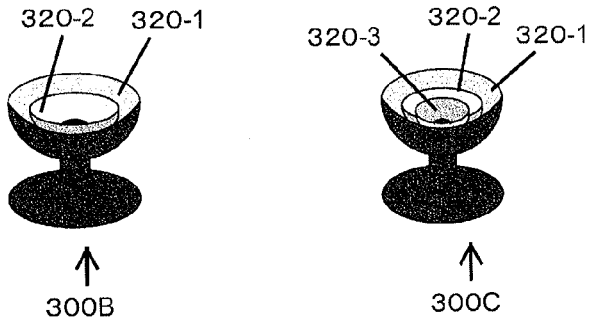
FIG. 3 A schematic view of soundproofing devices based on two embodiments.

FIG. 3 shows soundproofing devices according to two embodiments, labeled 300B and 300C. A soundproofing plate based on the embodiments is formed by mounting a soundproofing device 300B on the substrate 100 instead of the soundproofing device 300A according to the comparative reference example. Similarly, by mounting the soundproofing device 300C on the substrate 100 instead of the soundproofing device 300A, a soundproofing plate based on another embodiment is made.

Figure 4:
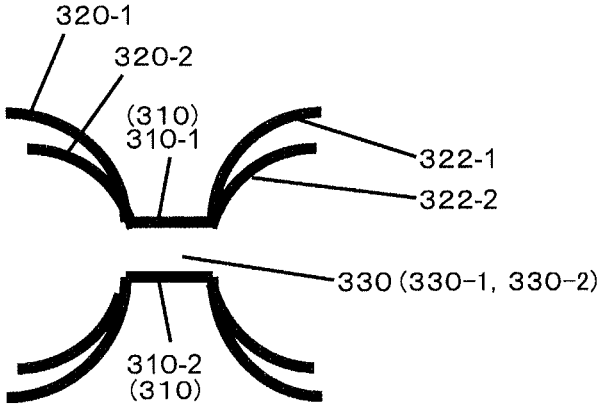
FIG. 4 A schematic view of a soundproofing device according to an embodiment.

The soundproofing devices 300B and 300C according to the embodiments are composed of a multiplex structure. In other words, in the case of soundproofing device 300B, as shown in FIG. 4, the multiplex structure is a double structure consisting of a first structure and a second structure nested therein, the first structure having in a central portion 310-1 a through hole ("first air passage hole") communicating with the through hole 200 of the substrate 100, having at both ends or one end a first sound collecting portion 320-1 of a size larger than the aperture area of the first air passage hole 330-1 and arranged to reflect the incident noise, the second structure being nested inside the first structure, having at a central portion 310-2 a through hole ("second air passage hole") communicating with the through hole 200 of the substrate 100, and having at both ends or one end a second sound collecting portion 320-2 of a size larger than the aperture area of the second air passage hole 330-2 and arranged to reflect the incident noise. In the case of FIG. 4, the first sound collecting portion 320-1 and second sound collecting portion 320-2 are separate bodies (separate layers), but the central portion 310-1 of the first structure and the central portion 310-2 of the second structure are integrated, being realized by a hollow axial member 210 having a single air passage hole 330 formed therein. If desired, they may be formed from separate elements, in such a manner that the central portion 310-2 of the second structure is housed inside the central portion 310-1 of the first structure. The concave surface portion of the first sound collecting portion 320-1 forms a sound collecting surface 322-1 that reflects incident noise, and the concave surface portion of the second sound collecting portion 320-2 forms a sound collecting surface 322-2 that reflects incident noise.

In the case of soundproofing device 300C according to another embodiment, the multiplex structure is a triple structure consisting of a first structure, a second structure nested therein, and a third structure nested therein. The first structure comprises a first sound collecting portion 320-1, the second structure comprises a second sound collecting portion 320-2 nested inside the first sound collecting portion, and the third structure comprises a third sound collecting portion 320-3 nested inside the second sound collecting portion. In the following descriptions, a soundproofing device according to the comparative reference example indicated by reference number 300A will sometimes be referred to as a one-pair type. Similarly, the soundproofing device according to the embodiment indicated by reference number 300B will sometimes be referred to as a two-pair type, and the soundproofing device according to the embodiment indicated by reference number 300C will sometimes be referred to as a three-pair type.

As described above, soundproofing devices 300 based on specific embodiments have a hollow axial member 310 and multiple pairs of sound collecting portions 320 provided at both end portions thereof. Regarding the sound collecting portion 320, the comparative reference example uses a sound collecting portion 320 comprising one pair, and the embodiments use sound collecting portions 320-1, 320-2 comprising two pairs, and sound collecting portions 320-1, 320-2, 320-3 comprising three pairs. Thus, soundproofing device 300B comprising two pairs of sound collecting portions 320-1, 320-2 has a double structure (see FIG. 4), and soundproofing device 300C comprising three pairs of sound collecting portions 320-1, 320-2, 320-3 has a triple structure.

In the embodiments, the proportion of the maximum diameter of the sound collecting portion with respect to the outer diameter (outer diameter of the pipe) of the hollow axial member 310 should preferably be in the range of about 1/8 to 1/1. Additionally, while not limited thereto, the material of the soundproofing device 300 may be acrylic, rubber or vinyl chloride, the length in the axial direction may be 5 to 100 mm, and the thickness of the sound collecting portion 320 may be about 1 to 10 mm.

In FIG. 1, the soundproofing device 300 is provided on only one side of the substrate 100. This may be replaced by an arrangement wherein the soundproofing device 300 is provided on both sides of the substrate 100. Additionally, while FIG. 1 shows sound collecting portions formed on both ends of the sound collecting device 300, the sound collecting portion may be formed on only one end, and the other end terminated with the hollow axial member. Alternatively, two of these types of soundproofing devices (one end in the form of a sound collecting portion) may be prepared, and mounted on both sides of the substrate in alignment with the through hole. In other words, the soundproofing plate may be assembled by mounting to the left side of the substrate the end portion of the first soundproofing device which is the other end from that terminated by the hollow axial member, and mounting to the right side of the substrate the end portion of the second soundproofing device which is the other end from that terminated by the hollow axial member.

Additionally, as the substrate, it is possible to use a first and second substrate that are arranged face-to-face, the multiplex structure mounted on the first and second substrates, the first sound collecting portion arranged to correspond to the surfaces of the first and second substrates, and the multiplex structure substantially extending from the first substrate to the second substrate. This can be achieved by mounting on the second substrate a sound collecting portion positioned at the right end of the soundproofing device 300 disposed on the right side of the substrate 100.

<Experiments>

Figure 5:
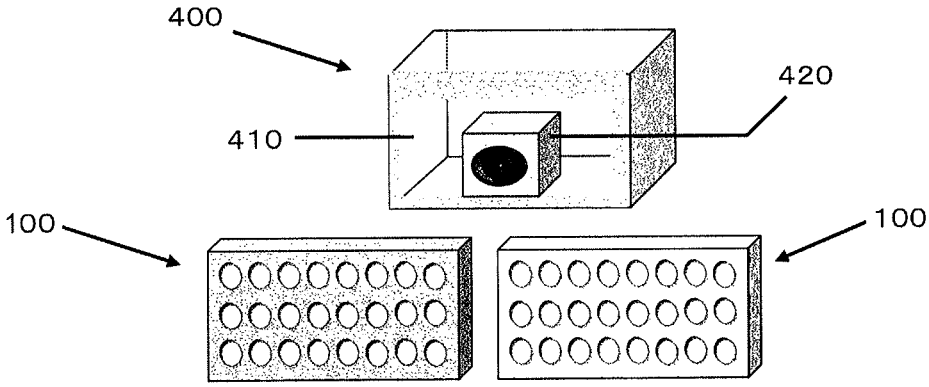
FIG. 5 A schematic view of an experimental system for a soundproofing plate.

FIG. 5 is a schematic view of an experimental apparatus relating to an embodiment. The above-described soundproofing plates (the one-pair type of the comparative reference example, the two-pair type of an embodiment and the three-pair type of an embodiment) or a substrate 100 having only holes (through holes) were installed in the front surface aperture portion 410 of the box 400, and the gap with the front surface aperture portion 410 was sealed with duct tape. A speaker was placed as a noise source 420 inside the box 400, and various types of noise were reproduced. The wiring between the noise source 420 and the amp was passed from the back surface of the box 400, and this gap was also sealed with duct tape. The magnitude of the noise issuing from the noise source 420 was about 100 dB. Soundproofing plates (the one-pair type of the comparative reference example, the two-pair type of an embodiment and the three-pair type of an embodiment) with varying shapes of the soundproofing devices and the substrate 100 with only holes were interchanged and the noise was measured at a point 60 cm outside the plates, then compared with that in the absence of a plate.

In the experiments, the ratio (aperture ratio) of substrate hole area/total substrate area for the one-pair type substrate of the comparative reference example was 5%, the ratio (aperture ratio) of substrate hole area/total substrate area for the two-pair type substrate of an embodiment was 6% (120% of the one-pair type), and the aperture ratio for the three-pair type embodiment was 9% (180% of the one-pair type). Here, the substrate aperture ratio is a measure of the amount of air flow. For the two-pair type embodiment 300B (see FIG. 3), the amount of air flow was 120% that of the one-pair type 300A of the comparative reference example, and for the three-pair type of embodiment 300C, the amount of air flow was 180%. Additionally, the radius of curvature of the sound collecting portion is preferably such that the ratio R/pipe outer diameter=1.25 to 0.5. Here, the pipe outer diameter means the outer diameter when the hollow axis is formed of a circular tube, and the sound collecting portion is formed on both ends of the tubular hollow axis. In actuality, R was tested at 20 to 40 mm (radius) when the outer diameter was 40 mm.

<Experimental Results>

Figure 6:
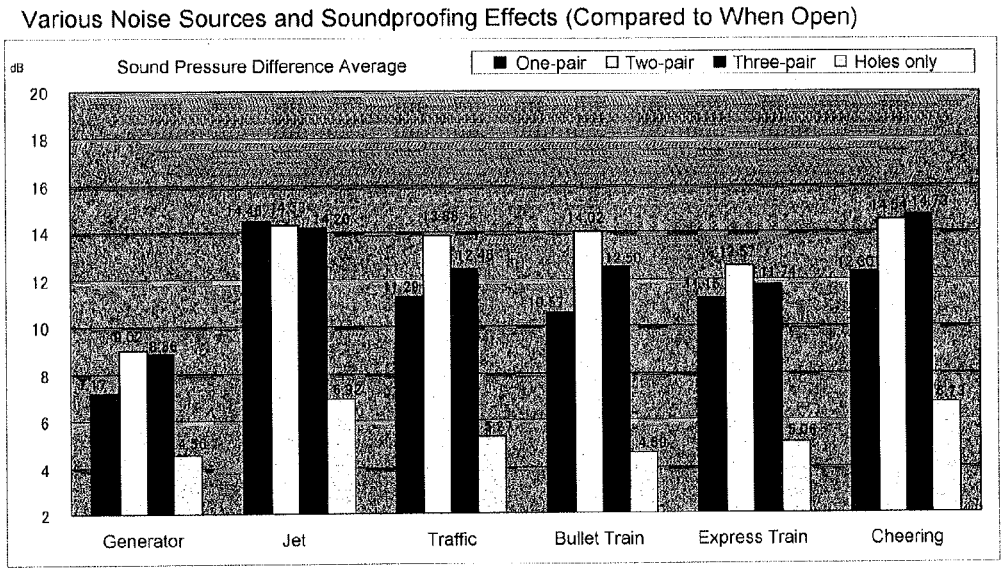
FIG. 6 A graph showing soundproofing effects of various soundproofing plates for various noise sources.

Upon experimenting with various noise sources ("generator", "jet", "traffic", "bullet train", "express train", "cheering") as shown in FIG. 6, improvements in the soundproofing effect were observed in both the two-pair type and the three-pair type with respect to the comparative reference example overall despite the fact that the aperture ratios (and therefore the amount of air flow) of the substrate increased relative to the one-pair type of the comparative reference example. Therefore, equivalent soundproofing effects were able to be obtained with a higher aperture rate (and therefore amount of air flow). In other words, if the aperture ratio of the substrates is constant, then the soundproofing devices of two-pair type and three-pair type according to the embodiments had a higher soundproofing effect.

Figure 7:
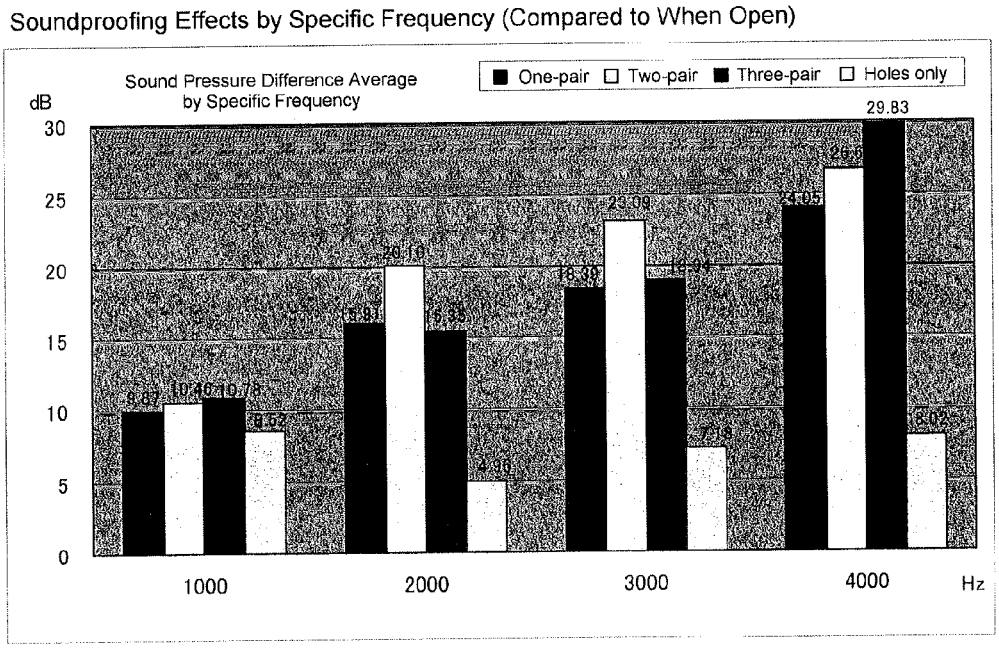
FIG. 7 A graph showing average sound pressure differences of various soundproofing plates for specific frequencies.

FIG. 7 shows the measurement results when playing specific frequencies through the speaker. As the frequency becomes higher, an improvement in the soundproofing effect is observed in the two-pair and three-pair type embodiments compared to the one-pair type of the comparative reference example. When considering that the tested two-pair type and three-pair type had a larger substrate aperture ratio (and therefore amount of air flow) than the one-pair type of the comparative reference example, if the aperture ratio (and therefore amount of air flow) of the substrate is kept constant, the soundproofing devices of two-pair type and three-pair type are capable of increasing the soundproofing effects with respect to high frequencies as compared to the one-pair type soundproofing device.

Figure 8:
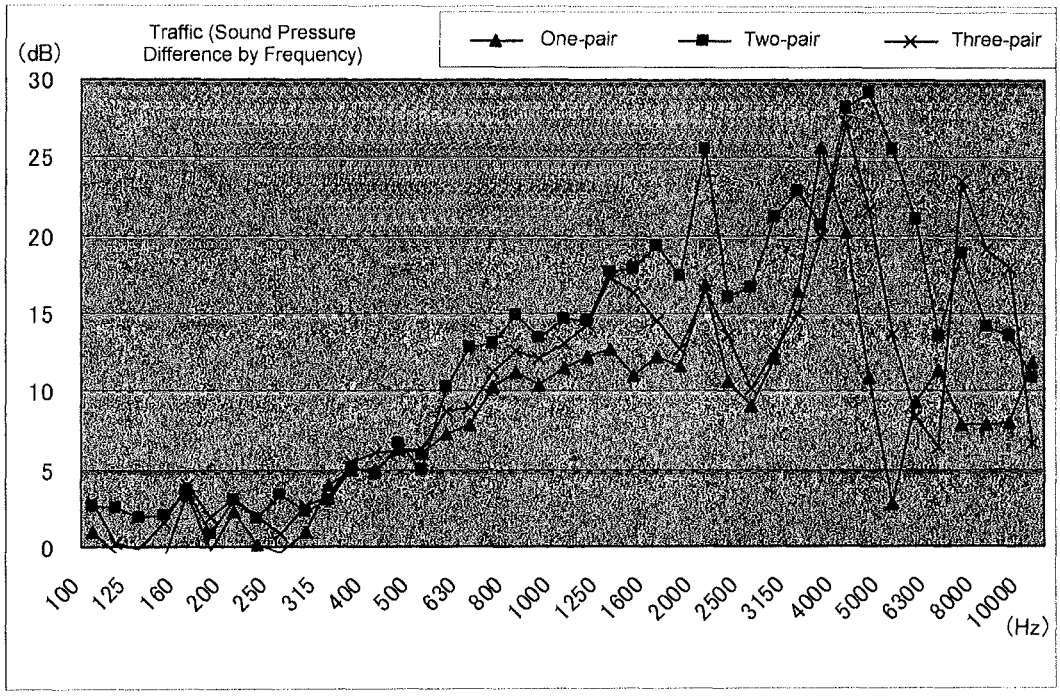
FIG. 8 A graph showing frequency properties of sound pressure differences in various soundproofing plates when using traffic noise as the noise source.

FIG. 8 shows the measurements across a frequency distribution when playing automobile traffic noise through the speaker. While a sudden drop in the soundproofing effect is observed in the high frequency region (above around 4000 Hz) for the one-pair type of the comparative reference example, the drop was suppressed for the two-pair and three-pair types.

Additionally, regarding the shape, a soundproofing plate with an air flow effect having "wedge-shaped hollow pipes" was used for each of a plurality of holes of diameter at least 15 mm and at most 40 mm opened in a single plate. A "wedge-shaped hollow pipe" refers to a "tubular pipe" with a diameter of at least 10 mm and at most 30 mm and a length of at least 5 mm, having a "trumpet-shaped pipe (flared pipe)" with curvature (a slight curve), with a larger diameter of at least 15 mm and at most 40 mm at both ends thereof, one end of which is connected to a hole in the aforementioned plate.

DESCRIPTION OF THE REFERENCE NUMBERS

100 substrate
200 through hole
300 soundproofing device
300A soundproofing device of comparative reference example
300B soundproofing device of embodiment
300C soundproofing device of embodiment
320-1 first sound collecting portion
320-2 second sound collecting portion
320-3 third sound collecting portion
310 central portion
310-1 first central portion
310-2 second central portion
330 through hole (air passage hole) of soundproofing device

The invention claimed is:

1. A soundproofing plate comprising:

a substrate having at least one through hole formed therein; and a soundproofing device mounted on the through hole of the substrate;

the soundproofing device having a multiplex structure having at least a first structure and a second structure nested therein;

the first structure comprising a first air passage hole disposed in the center and communicating with the through hole of the substrate, and a first sound collecting portion disposed at both ends or one end and having a larger size than the aperture area of the first air passage hole, and being arranged so as to reflect incident noise; and the second structure nested in the first structure, comprising a second air passage hole disposed in the center and communicating with the through hole of the substrate, and a second sound collecting portion disposed at both ends or one end and having a larger size than the aperture area of the second air passage hole, and being arranged so as to reflect incident noise.

2. The soundproofing plate according to claim 1, wherein the first and second sound collecting portions are provided on both ends of the multiplex structure.

3. The soundproofing plate according to claim 1, wherein the first structure has a first hollow axial member, inside which is defined the first air passage hole; and the second structure has a second hollow axial member, inside which is defined the second air passage hole.

4. The soundproofing plate according to claim 3, wherein the first hollow axial member and the second hollow axial member are integrated into a single hollow axial member.

5. The soundproofing plate according to claim 1, wherein the substrate comprises first and second substrates arranged face-to-face;

the multiplex structure is mounted on the first and second substrates;

the first sound collecting portion is arranged in correspondence with the surfaces of the first and second substrates; and the multiplex structure extends substantially from the first substrate to the second substrate.

6. The soundproofing plate according to claim 1, wherein the multiplex structure comprises a third structure nested in the second structure.

7. The soundproofing plate according to claim 1, wherein the multiplex structure is provided on only one side of the substrate.

8. The soundproofing plate according to claim 1, wherein the multiplex structure is provided on both sides of the substrate.

9. A soundproofing device mounted on a through hole of a substrate;

the soundproofing device having a multiplex structure having at least a first structure and a second structure nested therein;

the first structure comprising a first air passage hole disposed in the center and communicating with the through hole of the substrate, and a first sound collecting portion disposed at both ends or one end and having a larger size than the aperture area of the first air passage hole, and being arranged so as to reflect incident noise; and the second structure nested in the first structure, comprising a second air passage hole disposed in the center and communicating with the through hole of the substrate, and a second sound collecting portion disposed at both ends or one end and having a larger size than the aperture area of the second air passage hole, and being arranged so as to reflect incident noise.

10. The soundproofing device according to claim 9, wherein the first and second sound collecting portions are provided at both ends of the multiplex structure.

11. The soundproofing device according to claim 9, wherein the multiplex structure comprises a third structure nested in the second structure.

* * * * *